United States Patent [19]

Levasseur et al.

[11] Patent Number: 4,587,984

[45] Date of Patent: May 13, 1986

[54] COIN TUBE MONITOR MEANS

[75] Inventors: Joseph L. Levasseur, Chesterfield; Ronald A. Hoorman, St. Peters, both of Mo.

[73] Assignee: H. R. Electronics Company, St. Louis, Mo.

[21] Appl. No.: 500,024

[22] Filed: Jun. 1, 1983

[51] Int. Cl.[4] ..... G07D 9/00

[52] U.S. Cl. ..... 133/8 R; 133/8 R; 194/216

[58] Field of Search ..... 194/1 M, 1 N, DIG. 3, 194/1 L; 133/1 R, 2, 8 B, 8 D, 8 R, 4 R

[56] References Cited

U.S. PATENT DOCUMENTS

| | | | |
|---|---|---|---|
| 3,726,291 | 4/1973 | Onda | 133/4 R |
| 3,894,220 | 7/1975 | Levasseur | 194/1 N |
| 4,121,603 | 10/1978 | Hayashi | 133/4 R |
| 4,364,404 | 12/1982 | Hayashi et al. | 133/4 A |
| 4,381,835 | 5/1983 | Shah | 194/1 N |
| 4,491,140 | 1/1985 | Eglise et al. | 133/8 R |

*Primary Examiner*—Joseph J. Rolla
*Assistant Examiner*—Louise S. Heim
*Attorney, Agent, or Firm*—Haverstock, Garrett & Roberts

[57] ABSTRACT

A device for monitoring the coins in one or more coin tubes on a vending machine to maintain a running total of the coins therein that are available to pay back excess deposits and to make refunds. The device may include one or more coin tubes for containing a supply of coins of respective denominations, the coin tubes being included in a coin unit for receiving coins deposited in the vending machine and for directing the coins to the respective coin tubes. The coin unit includes an accumulator associated with each coin tube for counting each coin that enters therein and for subtracting therefrom the number of coins paid out, each of the accumulators including a mechanism for establishing a minimum and a maximum number of coins that can be maintained in the coin tube. The coin unit also has a deflector device that is responsive to the mechanism that establishes the maximum number of coins in each respective coin tube and is operable to prevent further deposited coins from entering the coin tube when there are a maximum number of coins therein, and the coin unit has a device that is responsive to the mechanism that establishes the minimum number of coins to inhibit the paying out of further coins therefrom when the number therein is at a minimum. The device may also have a display device operatively connected to the accumulators to display the number of coins in the respective coin tubes.

17 Claims, 5 Drawing Figures

COIN TUBE MONITOR MEANS

Many devices are in existence for monitoring the coinage in coin tubes including monitoring the coins remaining in the coin tubes used for making change and refunds on vending machines. For the most part, the known monitoring means have included mechanical devices such as feelers, electric switches, optical devices and Hall effect sensors which physically, electrically or optically sense the presence of coins in the coin tubes. Such devices usually operate on a go and no go basis in sensing the coins and/or number of coins in a coin tube as by the condition of the feeler or switch or the presence or absence of a light beam or the condition of a Hall effect device to determine if the coin tube has enough coins in it to be able to be operated to payout change. Mechanical feelers, switches, optical sensers and Hall effect devices have obvious disadvantages and limitations including being subject to breaking and failing or sticking, they are relatively slow acting as compared to modern circuit devices, and they are relatively susceptible to jamming. The known devices also require at least something that extends into or projects into the coin tubes to come in contact with or to be contacted or interrupted by the coins therein and some movement or change is necessary for such devices to respond. All of these conditions and limitations of the known devices limit their usefulness, cause relatively frequent repair and maintenance and increase the cost of operating and maintaining the coin tubes, and particularly the coin tubes used for making change in a vending machine. Since the coin tubes in a vending machine are the usual way coins are accumulated for payback it is important that the coin tubes be as clear and open as possible and free from maintenance and jamming. It is also important to know how many coins are in the coin tubes at all times.

The present invention teaches the construction and operation of novel means for monitoring the coins in a coin tube without requiring any element or member or light beam or other condition that senses coin movements or needs to enter or extend into the coin tubes or into the chutes that feed the coins so as to come in contact with the coins in the tubes or with the coins fed thereto. In fact, the present invention does not require any optical or other coin detector means to read or sense the presence or number of coins in the coin tubes. Instead, the present invention teaches a construction that makes it possible to know the number of coins that are in the coin tubes at all times from data produced in the other vending control means as a result of deposits made, coins paid back or refunded, and the difference between the number of coins deposited that are directed into the coin tubes and the number of coins that are passed to the cash box.

It is a principal object of the present invention to teach the construction and operation of novel means to monitor the number of coins in one or more coin tubes.

Another object is to know the number of coins remaining in a coin tube without having to sense the coins in the coin tube.

Another object is to reduce maintenance and trouble in vending machines by eliminating the need for coin sensors such as switches, optical sensors, Hall effect devices, inductive sensors and other devices and circuits to sense the presence of coins accumulated in coin tubes.

Another object is to provide means to continuously electronically monitor the number of coins available for payout in each coin tube in a vending machine.

Another object is to keep a record of the difference between the number of coins entering each payout coin tube in a vending control device and the number of coins that have been paid out therefrom.

Another object is to inhibit paying out coins from a coin tube when the number of coins therein is less than some predetermined number.

Another object is to reduce maintenance on vending and other coin controlled devices.

Another object is to simplify the construction of the coin tubes used in vending machines.

Another object is to reduce the possibility of a coin jam in the coin tubes of vending machines.

Another object is to provide improved coin tube monitoring means which are compatible with existing vending control circuits.

Another object is to enable displaying the quantity of remaining coins in each coin tube in a vending machine.

These and other objects and advantages of the present invention will become apparent after considering the following detailed specification of a preferred embodiment of the subject invention in conjunction with the accompanying drawings wherein.

Figure 1:
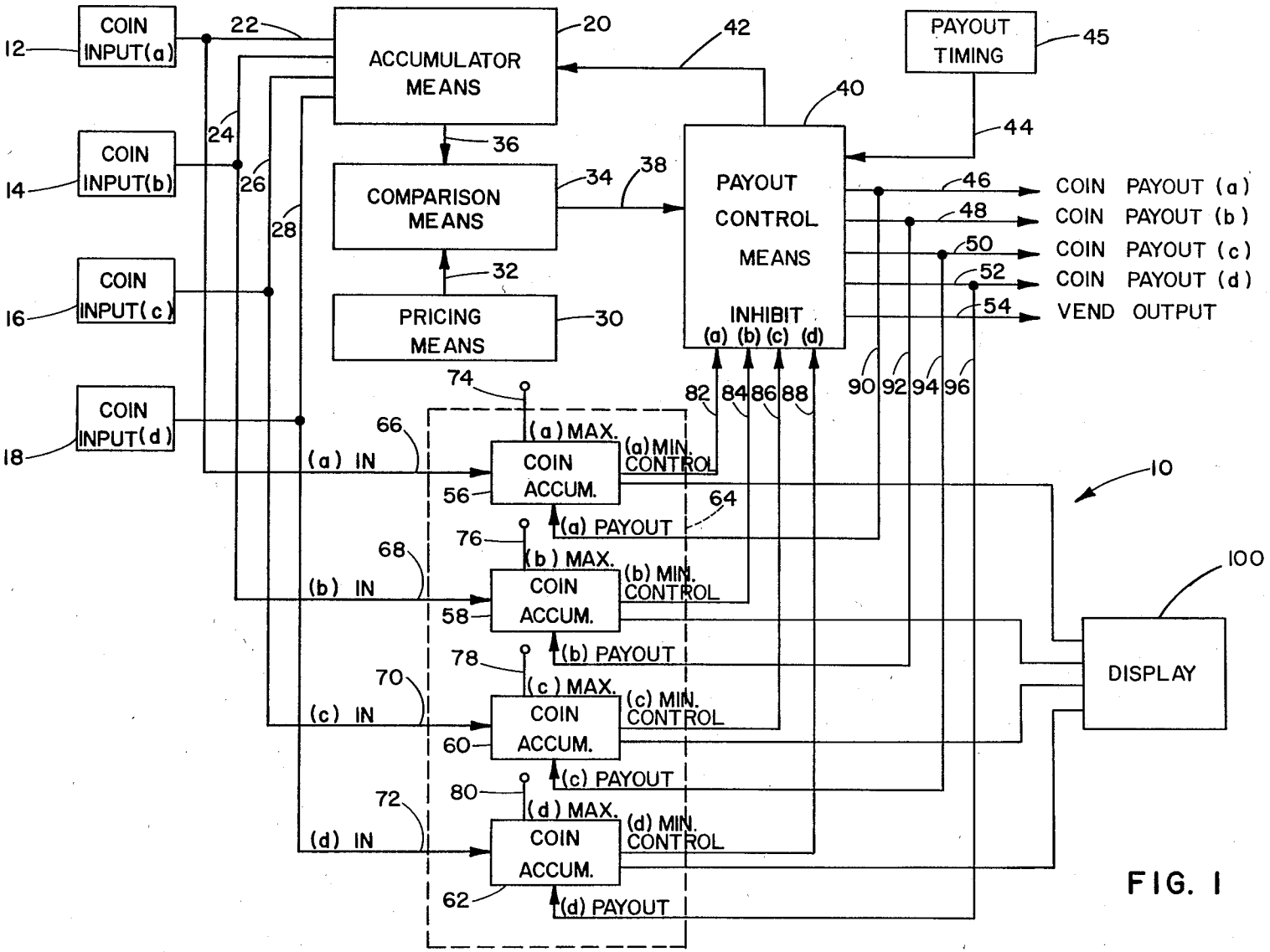
FIG. 1 is a block diagram showing the circuitry for coin tube monitoring means constructed according to the present invention.

Referring to the drawings more particularly by reference numbers, number 10 in FIG. 1 refers to a control circuit of a vending control device that includes coin tubes for accumulating coins to be used for payback, refund and escrow. The circuit 10, and the coin tubes associated therewith, are constructed and connected according to a preferred embodiment of the present invention and many of the circuit elements can be embodied in a micro-processor device if desired. The control circuit 10 is shown for illustration purposes having provision for recognizing, accumulating and monitoring four different denominations of coins and for generating signals representative of each different denomination of coin deposited. For example, coin input 12 may be a nickel input and includes means for producing an output signal in response to the deposit of each nickel coin. In like manner coin input 14 includes means to produce an output representative of each dime coin deposited, coin input 16 includes means to produce an output representative of each quarter coin deposited, and coin input 18 includes means to produce an output representative of each half-dollar (or dollar) coin deposited. The number of coins and coin tubes employed will vary depending on need, and the device can be made to accommodate a greater or a lesser number of different denomination coins.

The outputs of the coin units 12, 14, 16, and 18 are fed as inputs to an accumulator 20 on respective input leads 22, 24, 26, and 28. The accumulator 20 may be of conventional construction such as shown in Levasseur U.S. Pat. Nos. 3,841,456; 3,894,220; and 4,034,839 including having means for totalling the values of the coins deposited during each vending operation regardless of the denominations of the coins deposited until the amount accumulated at least equals the price of a selected vend.

The control circuit 10 includes pricing means 30 which establish the price of each article selected for vending under control of customer actuatable selection switches (not shown) and produces an output on lead 32 to represent the vend price. The lead 32 may include one or a plurality of leads depending on whether serial or parallel bit vend price information is used. The vend price information on the lead 32 is fed as one of two inputs to a comparator means or circuit 34 which receives other input information from the accumulator 20 on lead or leads 36. The signals present on the lead or leads 36 are representative of the amount of money deposited by the customer during a vending operation and is on accumulation of the value of all the coins deposited into the various inputs 12, 14, 16, and 18.

The comparator means 34 compares the vend price it receives on the lead 32 with the amount of deposits accumulated in the accumulator 20 on lead 36 and produces outputs on lead or leads 38 which represent the difference between the amount accumulated in the accumulator means 20 and the vend price established by the pricing means 30. This difference represents the amount of money or coinage, if any, that is to be paid to the customer as a result of an over deposit. If the amount accumulated in the accumulator 20 exactly equals the vend price, then, of course, no signal will be present on the lead 38 and no payback will occur.

The outputs of the comparator means 34 on the lead 38 are connected to payout control means 40 which has a plurality of inputs and outputs. One of the outputs from the payout control means 40 is lead 42 which is connected back to the accumulator means 20. Signals on the lead 42 represent coins paid back and corresponding amounts are subtracted from amounts accumulated in the accumulator means 20 due to coin deposits. As each coin is paid back and its amount substracted, the amount remaining in the accumulator 20 is reduced and this process continues until the amount remaining in the accumulator means 20 is the same as the vend price established by the pricing means 30. When this condition exists there will no longer be an output from the comparator means 34 present on the lead 38 and payback will be complete. The outputs of the payout control means can, in another embodiment, be connected to the pricing means 30 to add to the amount of the vend price therein until the amount in the pricing means 30 equals the amount in the accumulator 20.

The payout control means 40 has another input connection 44 which is from payout timing control 45. This input is used to control the timing in the payback circuit including the timing of the outputs therefrom. The payout control means 40 also has a plurality of other output connections on leads 46, 48, 50, and 52 which are connected to respective payout motors or solenoids (not shown) associated with the different denomination coin tubes wherein coins are accumulated for payback. Each time a signal is present on the lead 46, its associated payback motor or solenoid will be energized to payback one nickel coin. Likewise, when a signal is present on the lead 48 a dime motor or solenoid will be energized to payback a dime coin, when a signal is present on the lead 50 a motor or solenoid will be energized to payback a quarter coin, and when a signal is present on the lead 52 a motor or solenoid will be energized to payback a fifty cent or dollar coin.

The payback control means 40 has another output 54 labeled "vend output" on which vend signals are present to cause a vend operation to take place. A signal will be present on the lead 54 whenever an amount accumulated in the accumulator means 20 at least equals the amount of the vend price established by the pricing means 30. It is possible to postpone production of the vend signal on the output 54 until after payback is completed although this is usually not necessary or desirable since if the amount deposited at least equals the vend price there is no reason to delay causing the vend operation to take place until after payback is completed.

The circuit 10 also includes coin accumulators or counters 56, 58, 60, and 62 which are included in a separate circuit portion 64 shown in dotted outline. The coin accumulators 56–60 are associated with respective coin tubes 56A, 58A and 60A (FIG. 2) wherein nickel, dime and quarter coins are accumulated for use in making change or paying back overdeposits. A fourth coin tube 62A for half-dollar or dollar coins could be included if needed or desired. The nickel accumulator 56 has an input connection on lead 66 which has its opposite end connected to the output lead 22 of the nickel coin input device 12, the dime accumulator 58 has an input 68 which has its opposite end connected to the output of the dime coin input device 14, the quarter accumulator 60 has an input 70 which has its opposite end connected to the output of the quarter coin input device 16, and the half-dollar or dollar accumulator 62, when used, has an input 72 which has its opposite end connected to the output of the half-dollar or dollar coin input device 18.

Figure 3:
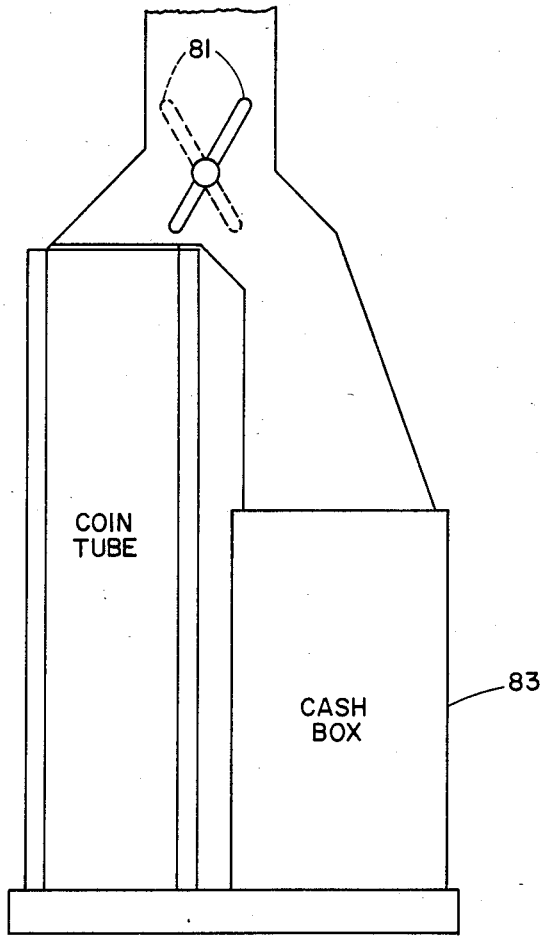
FIG. 3 is a right side view of the coin tubes of FIG. 2 showing the cash box and the means to control feeding of coins to the coin tube and to the cash box.

The nickel accumulator 56 has another output 74, labeled MAX, on which an output signal is produced whenever there is a predetermined maximum number of nickel coins present in the nickel coin tube 56A. The dime accumulator 58 in like manner has an output 76, also labeled MAX, on which signals are present to indicate that there are a maximum number of dime coins in the dime coin tube 58A, the quarter accumulator 60 has an output 78, labeled MAX, on which signals are present to indicate that there are a maximum number of quarter coins in the quarter coin tube 60A, and the half-dollar or dollar accumulator 62 has an output 80, labeled MAX, on which signals are present to indicate that there is a maximum number of half-dollar or dollar coins in the half-dollar or dollar coin tube 62A. Each of the accumulators 56, 58, 60, and 62 keeps a running total of the number of coins in the respective coin tube or tubes at all times. This is important to know in order to know whether coins of a particular denomination are available for payout or whether payout should be made from coin tubes for other denomination coins. This information can also be used to operate means such as deflector 81 in FIG. 3 to divert future coin deposits into the cash box 83. Each coin tube will have a similar coin deflector to control where the respective coins will be fed.

Each of the respective coin tube accumulators 56, 58, 60, and 62 also has a respective MIN output 82, 84, 86, and 88 connected to the payout control means 40. signals on these connections are used to control the payout control means 40 by inhibiting the paying out of coins of these respective denominations when the respective coin tubes have a minimum or less than a minimum number of coins remaining in them. This is so that coins are paid out or refunded based on availability of coins in the respective coin tubes. In other words if the number of nickel coins remaining in the nickel coin tube 56A, as represented by the amount in the nickel coin accumulator 56, falls below some predetermined minimum number of coins, then a signal present on the output lead 82 will inhibit the payout control means 40 from paying out nickel coins. The same is true of the other coin tubes 58A–62A and their associated accumulators.

The outputs of the payout control means 40 on leads 46, 48, 50, and 52 have connections back to the respective accumulators 56, 58, 60, and 62 on leads 90, 92, 94, and 96. Each time a payback signal is present on one of the payout leads 46–52 to energize the respective payback motor or solenoid, a signal is also sent to the respective accumulator 56–62 to reduce the amount accumulated therein by an amount representing the value of each coin paid back. Hence, the accumulators 56–62 receive inputs from the respective coin input devices 12, 14, 16, and 18 when coins are deposited in the vending machine, unless the respective coin tubes are blocked from receiving coins by signals present on their respective MAX output leads 74, 76, 78, and 80, in which case the deposited coins are diverted into the cash box. The number of coins that can enter the coin tubes until they are full can be used as the maximum number for the accumulators 56–62 in which case no coin deflector such as coin deflector 81 is required. In this way each of the accumulators 56–62 keeps a record as to how many deposited coins are accumulated therein up to the maximum number due to signals present on the inputs 66–72, and this amount is reduced by each coin paid back of each denomination by signals on the respective leads 90–96. This information can then be used to determine if a coin tube has sufficient coins in it to satisfy the needs for payback. All of this is accomplished in a device that does not require any mechanical, electrical, optical, Hall effect, or other sensing devices at or associated with the coin tubes themselves. Therefore, the only means that need be included at the coin tubes are the motor or solenoid operated means necessary to payout coins under control of the payout control means 40, and these means are usually located at the bottom of the respective coin tubes where they do not interfere with coin improvements thereabove in the tubes. The coin tubes can therefore be of relatively simple unobstructed construction, and the number of coins available in each of the different denomination coin tubes can be accurately monitored at all times. The present construction therefore provides means for not only knowing the number of coins of each denomination available for payback, but it can, if desired, control where newly deposited coins are directed based on need, and it knows when the number of coins available in each different coin tube falls below some predetermined number for some reason such as due to excessive paybacks therefrom or otherwise so that further paybacks will be made in coins of the other available denominations. This information can also be used to energize an exact change indicator, if desired, and the accumulators 56–62 can operate a display 100 to provide a visual indication of the number of coins in each coin tube.

Figure 2:
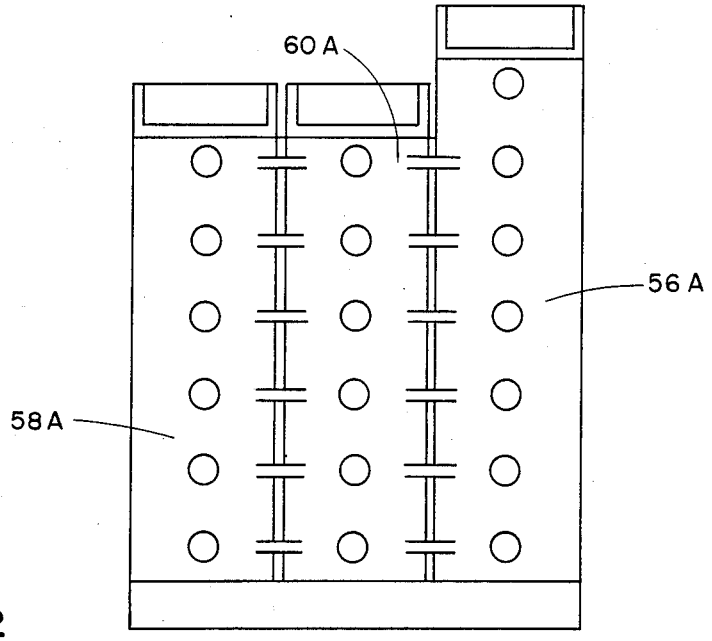
FIG. 2 is a side elevational view of a set of coin tubes for use with a vending machine equipped with the present invention.

FIG. 2 shows an arrangement of coin tubes for use in a vending machine or like device. The coin tubes 56A, 58A, and 60A are for nickel, dime, and quarter coins, as aforesaid, and each of the coin tubes 56A, 58A, and 60A has means located at its respective upper end for directing coins into the coin tube or alternatively for directing coins to the cash box. Each of the respective coin tubes also has means at its lower end operable by respective motor or solenoid means to discharge one or more coins at a time for payback or refund purposes. The motor operated means for paying back coins may be of conventional construction and are not per se part of the present invention.

Figure 4:
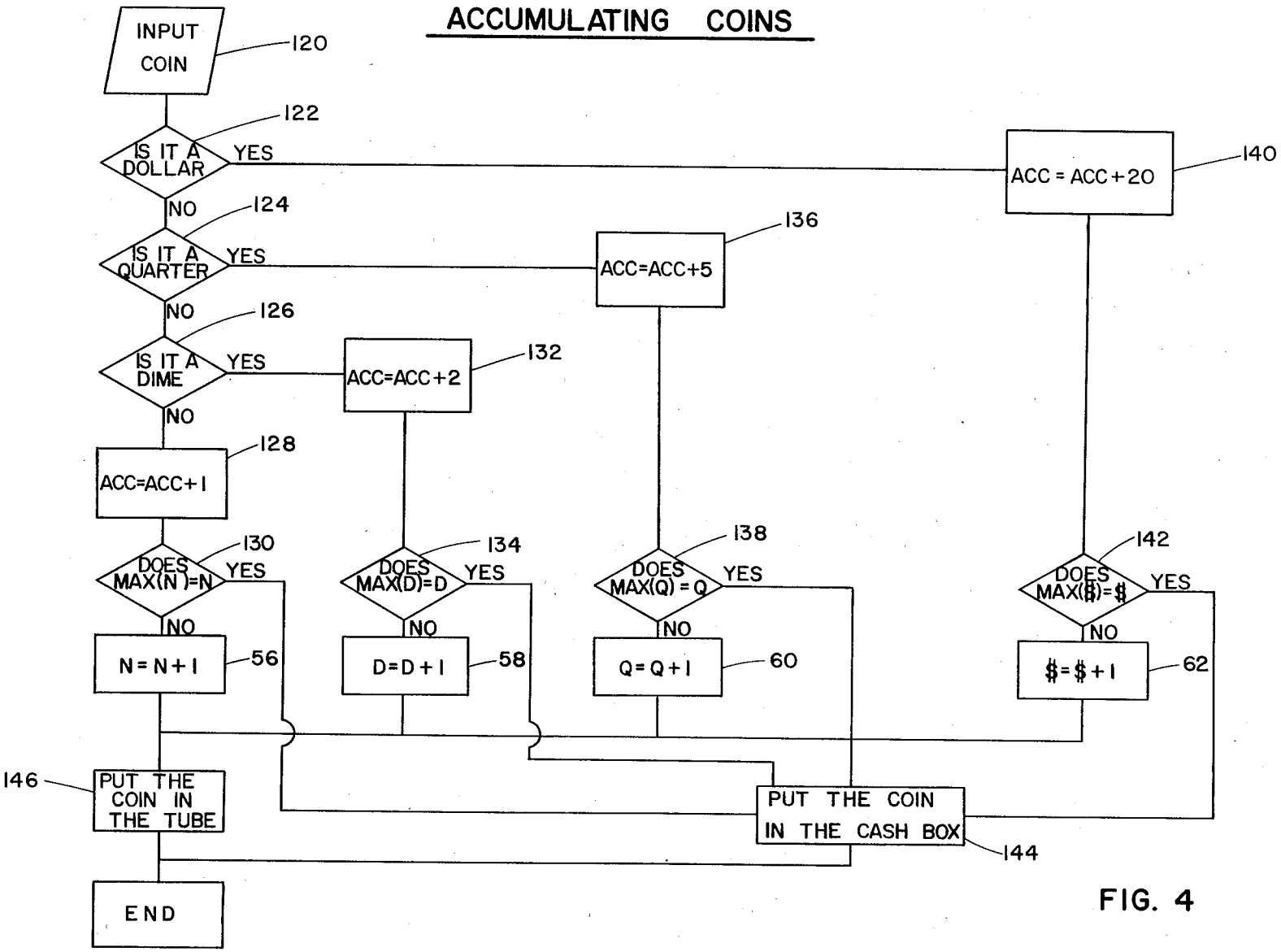
FIG. 4 is flow chart of the coin accumulating means for the circuit of FIG. 1; and, FIG. 5 is a flow chart of the payout control portions of the circuit of FIG. 1.
Figure 5:
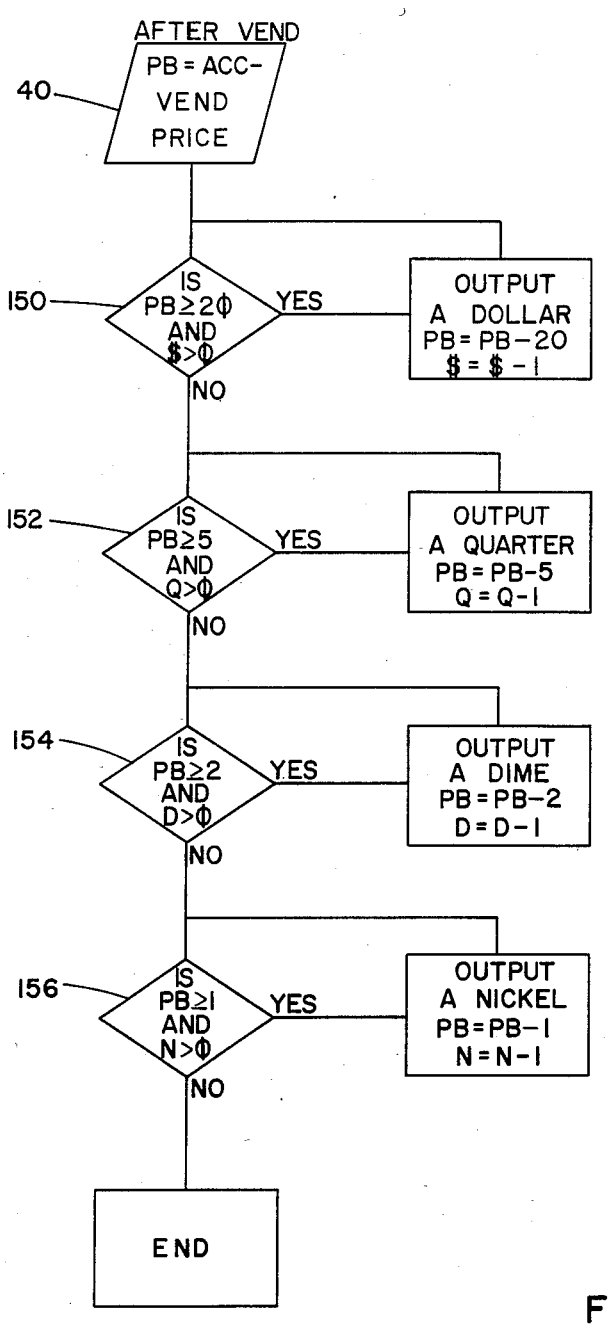

The flow chart of FIG. 4 is associated with the circuit portions that control the accumulation of coins in the various coin tubes and the flow chart of FIG. 5 is for the circuit portions used to control paying out coins from the respective coin tubes. Referring to FIG. 4, when a coin is deposited as into the coin input unit 120, it is sensed by means which determine its value and direct it mechanically toward its associated coin tube. If the coin deposited is a dollar coin then dollar control or logic means 122 will produce a YES output, but if the coin is not a dollar coin then a NO output will prevail on the mans 122 and the quarter control means 124 will take over to determine if the coin is a quarter. The quarter determining logic circuit 124 will produce a YES output if the coin is a quarter coin otherwise a NO output will prevail and the coin will be sensed by the dime control or logic means 126 which will produce a YES output if the coin is a dime otherwise a NO output if the coin is a nickel. If the coin is a nickel then the logic control circuitry 128 will produce a response indicating an accumulation of one nickel. If the nickel coin tube has the maximum possible number of nickels in it as determined by a YES output from the circuit block 130, then the deflector 81 associated with the nickel coin tube 56A will be in position to divert the incoming nickel coin into the cash box 83 and the number accumulated in the nickel accumulator 56 will not be increased. On the other hand, if the number of coins in the nickel coin tube 56A, and the corresponding number in the nickel accumulator 56, is less than N which is the maximum number of nickel coins permitted to be in the nickel coin tube, the control 130 will not have YES output but will have a NO output and this will cause the coin to enter the nickel coin tubes and the nickel accumulator 56 to increase the value accumulated therein by one. Similar means are provided for the dime, quarter, and half-dollar or dollar coin tubes 58A, 60A, and 62A.

In the case of a deposit of a dime, the circuitry 126 will be the controlling element, and will operate in conjunction with the accumulator 132 on the flow chart, the MAX circuitry 134, and the coin accumulator 58. In the case of the deposit of a quarter coin, the circuitry 124 will control and will operate in conjunction with the quarter accumulator 136, the quarter MAX control 138 and the quarter coin accumulator 60. In the case of half-dollar or dollar coin deposits, the circuitry 122 will control and will operate in conjunction with the half-dollar accumulator 140, the half-dollar or dollar coin tube MAX control 142 and the half-dollar or dollar accumulator 62. The YES outputs for the circuit 130, 134, 138, and 142 are all connected to means 144 labeled "put the coin in the cash box" which when energized causes coins to be diverted to the cash box 83 rather than to individual coin tubes. Each of the coin tube accumulators 56, 58, 60 and 62 also has a connection to a control means 146 labeled "put the coin in the coin tube" which operate when the coins in the respective coin tubes are below their predetermined MAX number of coins to cause respective coins deposited to enter the respective coin tubes rather than the cash box. The type of deflector means 81 used to control where the individual coins go can be of known construction such as being known type solenoid operated deflector means. Also the MAX conditions can be set to the maximum number of coins that the respective coin tubes can hold in which case no deflectors such as deflector 81 is needed and the overflows will be to the cash box.

FIG. 5 is a flow chart for the controls for the coin payout means. When the payout control means 40 produces a payout signal it is applied to circuit means which establish the value of coin to be paid back. For example, it is applied to and, if necessary, through the circuit elements 150, 152, 154 and 156. The circuit 150 determines if the amount to be paid back is greater than or equal to twenty, the number of nickels in a dollar coin where dollar coins are used. If it is determined that the count is equal to or greater than twenty by a YES response on the element 150 a dollar coin will be paid back, if available. If the answer of circuit 150 is NO instead of YES then the output of circuit 40 is applied to the circuitry 152 which will determine if the amount represented by the output of the payback control means 40 is greater than or equal to 5, the number of nickels in a quarter. If the answer is YES and there are more than zero quarter coins in the quarter coin tube, then a quarter coin will be paid back reducing the number of quarter coins in the tube, and the corresponding amount accumulated in the accumulator 20, by 5. The new output of the comparator 34 will then be applied to and through the payout control mean 40 to the circuit element 152 to see if another quarter should be paid back. If the new output of the circuit 40 indicates a condition that is still equal to or greater than 5 another quarter coin will be paid back otherwise if the output represent a value that is less than 5, the circuit 152 will produce a NO output for applying to the circuitry 154 to determine if the amount is greater than or equal to 2 the amount necessary to payback a dime coin. If the answer is YES and there are dime coins available in the dime coin tube then payback will be made in one or more dime coins until the output of the circuitry 154 is NO. When this occurs a signal will be applied to the circuitry 156 to determine in a similar manner if a nickel coin is to be paid back. Each time a coin is paid back there will be a corresponding reduction on the amount accumulated in the accumulator 20. This process continues until the amount in the accumulator 20 equals the amount in the pricing means 30 whereupon payback is terminated.

The circuitry for the subject device including the particular way in which the circuits are connected and operated can be varied considerably, and the present circuit can be constructed to use parallel or serial information and signals. The important thing is that the present control circuit enables the continuous monitoring of coins in one or more coin tubes in a vending or other similar machine, and it does so without requiring any coin sensing means on or in association with the coin tubes. The present means also can be adopted to be used with existing vend control circuits such as those identified in the patents mentioned above with a minimum of structural and circuit modification or change. With the present device there is much less to go wrong in a vending machine equipped with coin tubes used for payback and with the circuitry associated therewith.

Thus there has been shown and described a novel means for monitoring the coinage in the coin tubes of a vending or other coin operated device, which monitoring means fulfills all of the objects and advantages sought therefor. It will be apparent to those skilled in the art however, that many changes, variations, modifications, and other uses and applications for the subject device are possible, and all such changes, variations, modifications, and other uses and applications which do not depart from the spirit and scope of the invention are deemed to be covered by the invention which is limited only by the claims which follow.

What is claimed is:

1. Means to keep a running total of the number of coins in a coin tube having an input end at which coins enter the coin tube and an output end, said coin tube being an unobstructed tubular member whereby coins entering at the input end accumulate therein in a stack without the necessity of having any means on or adjacent to the coin tube capable of detecting or sensing the level of coins therein, said means to keep a running total comprising means for producing a signal representative of each coin deposited, means adjacent to the output end of the coin tube for discharging coins therefrom, means independent of the coin tube to establish a predetermined maximum number of coins to be in the coin tube, means to divert coins from entering the coin tube when the number of coins therein at least equals the predetermined maximum number, means to keep a count of the number of coins that enter at the input end of the coin tube, and means for reducing the count in the means to keep a count by the number of coins discharged from the output end of the coin tube, said means to keep a count including means responsive to the deposit of each coin when the number of coins in the coin tube is less than the predetermined maximum number, the count in the means to keep a count being representative of the number of coins in the coin tube.

2. The means of claim 1 including a plurality of coin tubes for accumulating coins of different denominations, each coin tube having an input end at which coins enter and an output end, means adjacent to the output end of each of the coin tubes for discharging coins therefrom, separate means to keep a count of the number of coins in each respective coin tube and means to reduce the count in each of the separate means to keep a count by the number of coins discharged from the respective coin tube.

3. Means for monitoring coins in the payout coin tube of a vending machine or like device comprising means for producing a signal representative of each coin deposited a payout coin tube having an inlet end for receiving coins after they have been deposited in the vending machine, an outlet end having means associated therewith for discharging selected numbers of coins from the coin tube for payback and refund purposes, said coin tube being an unobstructed tubular member whereby coins entering at the input end accumulate therein in a stack without the necessity of having any means on or adjacent to the coin tube capable of detecting or sensing the level of coins therein, means to determine the number of coins in the coin tube including means to establish the difference between the number of coins that enter the coin tube at the inlet end and the number of coins discharged therefrom, means independent of the coin tube for establiahing a predetermined maximum number of coins in the coin tube, means responsive to the coin tube having the predetermined maximum number of coins accumulated therein including means for diverting from entry into the coin tube subsequent coins deposited in the vending machine rather than allowing them to enter the coin tube, means on the vending machine responsive to each coin deposited therein for accumulating the value of coins deposited in the vending machine during each vending operation, means for producing an output response representative of the difference between the amount accumulated in the accumulator means and the price of a selected vend, and means to payback coins from the coin tube when the customer requests a refund and under circumstances where an amount deposited exceeds the price of a selected vend, said payback means including means operatively connected to the means to determine the number of coins in the coin tube to effect the difference between the number of coins that enter the coin tube and the number of coins discharged therefrom.

4. The means of claim 3 wherein the vending machine has a plurality of payout coin tubes at least one corresponding respectively to each denomination coin that can be paid back, each of said coin tubes having an inlet end for receiving coins of its respective denomination, an outlet end having means associated therewith for discharging selected numbers of coins therefrom, means for determining the number of coins in each respective coin tube including means to establish the difference between the number of coins that enter each respective coin tube and the number of coins discharged therefrom, said means independent of the coin tube for establishing a predetermined maximum number of coins in the coin tube including means for establishing a predetermined maximum number of coins in each respective coin tube.

5. The means of claim 3 wherein the vending machine has coin receiving means including means for generating a signal representative of each coin deposited therein, payout means for paying out coins from the coin tube including means for generating a signal representative of each coin that is paid out, said means to determine the number of coins in the coin tube including a coin tube accumulator having a first operative connection to the coin receiving means and a second operative connection to the coin payout means, means energizable by said means for establishing a predetermined maximum number of coins in the coin tube to divert coins from entering the coin tube and from making an entry in the coin tube accumulator when the predetermined maximum number of coins is present in the coin tube.

6. The means of claim 3 including display means operatively connected to the means to determine the number of coins in the coin tube to produce a visual display thereof.

7. The means of claim 3 including means associated with the coin tube accumulator means for establishing a minimum number of coins in the coin tube below which coins cannot be discharged therefrom, said last named means including means operatively connected to the payback means to inhibit operation thereof to prevent the discharge of coins from the coin tube when the number of coins in the coin tube has been reduced at least to the established minimum number.

8. Means to monitor the coins available in a coin tube on a vending machine comprising means for producing a signal representative of each coin deposited, a coin tube having a coin input thereto and means to discharge coins therefrom, said coin tube being an unobstructed tubular member whereby coins entering at the input end accumulate therein in a stack without the necessity of having any means on or adjacent to the coin tube capable of detecting or sensing the level of coins therein, means to feed coins deposited in the vending machine to the coin tube for accumulation therein, means independent of the coin tube to establish a predetermined maximum number of coins that are permitted to be in the coin tube, means responsive to said last named means to divert coins deposited from entering the coin tube if the number of coins therein at least equals the predetermined maximum number of coins established, means to keep a running accumulation of coins entering the coin tube, and means to reduce the running accumulation by each coin that is discharged from the coin tube.

9. The means of claim 8 including means independent of the coin tube to establish a predetermined minimum number of coins that can be retained in the coin tube, said last named means including means to prevent the discharge of coins from the coin tube when the number of coins contained therein has fallen at least to the predetermined minimum number.

10. The means of claim 8 including a plurality of coin tubes each constructed to receive different respective denomination coins deposited in the vending machine, and means associated with each coin tube but independent thereof to establish a predetermined maximum and a predetermined minimum number of coins to be permitted to be accumulated therein.

11. In a vending machine having coin receiving means into which coins are deposited, means to accumulate the value of coins deposited during a vending operation, means to compare the cost of an article selected for vending with the amount of deposit accumulated to produce a response representative of the difference therebetween, means to payback amounts deposited in excess of the cost of a vend including at least one coin tube having an inlet end for receiving selected coins deposited and an outlet end having means associated therewith which when energized discharge a coin therefrom, a cash box for accumulating coins not needed for payback, and means to control whether a deposited coin will go into the coin tube or into the cash box, the improvement comprising:

said coin tube being an unobstructed tubular member whereby coins entering at the input end accumulate therein in a stack without the necessity of having any means on or adjacent to the coin tube capable of detecting or sensing the level of coins therein, means for producing a signal representative of each coin deposited, means to keep an ongoing count of the number of coins in the coin tube including a coin tube accumulator having a first input operatively connected to the coin receiving means, a second input operatively connected to the payback means to reduce the amount accumulated therein by each coin discharged therefrom, means independent of thecoin tube for establishing a predetermined maximum and a predetermined minimum number of coins that can be in the coin tube, a first output to the coin tube accumulator including means for establishing thereon a response whenever the number of coins in the coin tube at least equals the predetermined maximum number of coins that can be in the coin tube, and a second output to the coin tube accumulator including means for establishing thereon a response whenever the number of coins in the coin tube has been reduced at least to the predetermined minimum number of coins that can be therein, said first output having an operative connection to the means which control whether a deposited coin will go into the coin tube and be counted or into the cash box and not be counted depending on whether there are a maximum number of coins in the coin tube when a deposit is made, and said second output being operatively connected to the payback means to inhibit the payig back of coins from the coin tube when the number of coins therein is reduced at least to the predetermined minimum number.

12. In the vending machine of claim 11 the further improvement of a plurality of coin tubes each capable of being used to payback coins of different respective denominations, each of said payback tubes having an associated coin tube accumulator with first and second inputs and first and second outputs connected respectively as set forth above.

13. In the vending machine of claim 11 the further improvement of display means operatively connected to the coin tube accumulator for providing a visual indication as to the number of coins contained therein.

14. In the vending machine of claim 12 the further improvement of display means operatively connected to each of the respective coin tube accumulators for providing a visual display as to the number of coins contained in each of the coin tubes.

15. In the vending machine of claim 11 the payback means includes a control circuit having an operative connection to the means at the outlet end of the coin tube energizable to discharge coins therefrom.

16. In the vending machine of claim 11 wherein the means to keep an ongoing count are included in a micro-processor device.

17. Means to keep a running total of the number of coins in a coin tube mounted on a vending machine having means thereon for receiving deposited coins, and means for producing a signal representative of each coin deposited, said coin tube having an input end at which coins enter the coin tube and an output end, said coin tube being an unobstructed tubular member whereby coins entering at the input end accumulate therein in a stack without the necessity of having any means on or adjacent to the coin tube capable of detecting or sensing the level of coins therein, means for discharging coins from the output end of the coin tube, means independent of the coin tube to establish a predetermined maximum number of coins that can be in the coin tube, means to divert coins from entering the coin tube when the number of coins therein at least equals the predetermined maximum number, means to keep a count of the number of coins that enter at the input end of the coin tube, said means to keep a count having an operative connection to the coin receiving means and including means for accumulating a value to represent all of the coins directed into the input end of the coin tube, and means for reducing the count of the number of coins in the coin tube by the number of coins discharged from the output end thereof, said means to keep a count including means responsive to the deposit of each coin when the number of coins in the coin tube is less than the predetermined maximum number.

* * * * *

UNITED STATES PATENT OFFICE

CERTIFICATE OF CORRECTION

Patent No. 4,587,984 Dated May 13, 1986

Inventor(s) Joseph L. Levasseur & Ronald A. Hoormann

It is certified that error appears in the above-identified patent and that said Letters Patent are hereby corrected as shown below:

Column 3, line 20, "on" should be ---an---.

Column 4, line 64, "sig-" should be --- Sig- ---.

Column 5, line 46, "improvements" should be ---movements---.

Column 6, line 20, "mans" should be ---means---.

Column 8, line 50, "posited" should be ---posited,---.

Column 10, line 58, "thecoin" should be ---the coin---.

Column 11, line 11, "payig" should be ---paying---.

Signed and Sealed this

*Twenty-sixth* Day of *August 1986*

[SEAL]

*Attest:*

DONALD J. QUIGG

*Attesting Officer* *Commissioner of Patents and Trademarks*